US007316397B2

(12) United States Patent
Friedman

(10) Patent No.: US 7,316,397 B2
(45) Date of Patent: Jan. 8, 2008

(54) METHOD OF PLAYING WAGERING GAMES

(75) Inventor: Stacy A. Friedman, San Francisco, CA (US)

(73) Assignee: Olympian Gaming LLC, Beaverton, OR (US)

( * ) Notice: Subject to any disclaimer, the term of this patent is extended or adjusted under 35 U.S.C. 154(b) by 82 days.

(21) Appl. No.: 10/271,684

(22) Filed: Oct. 15, 2002

(65) Prior Publication Data

US 2003/0075863 A1 Apr. 24, 2003

Related U.S. Application Data

(60) Provisional application No. 60/329,610, filed on Oct. 15, 2001.

(51) Int. Cl.
*A63F 3/08* (2006.01)
*A63F 1/00* (2006.01)
*A63F 9/24* (2006.01)

(52) U.S. Cl. ..... 273/274; 273/292; 273/148

(58) Field of Classification Search ..... 273/274, 273/292, 146

See application file for complete search history.

(56) References Cited

U.S. PATENT DOCUMENTS 5,542,671 A * 8/1996 Stewart ..... 273/146
5,700,010 A * 12/1997 Mimier ..... 273/292
5,762,334 A * 6/1998 Kosi ..... 273/148 R
5,964,463 A * 10/1999 Moore, Jr. ..... 273/274
6,152,450 A * 11/2000 Boudreaux et al. ..... 273/292
6,305,686 B1 * 10/2001 Perrie et al. ..... 273/146

OTHER PUBLICATIONS

Scarne, John, Scarne's Encyclopedia of Games, 1973, Chapter 24, "Dice and Their Many Games".*

* cited by examiner

*Primary Examiner*—Eugene Kim
*Assistant Examiner*—Urszula M Cegielnik
(74) *Attorney, Agent, or Firm*—Muskin & Cusick LLC

(57) ABSTRACT

The embodiments of the present invention provide a method of playing wagering games with dice, or other gaming indicia. According to a first embodiment of the present invention, a shooter places a wager and rolls a pair of standard six-sided dice. The shooter then rolls the dice repeatedly until either the sum of the two dice is less than, or equal to, the previous sum rolled, or the number of rolls qualifies for a maximum game payout. Once the shooter stops rolling, the total number of rolls is compared with a pay table and the wager is resolved. The embodiments of the present invention may be implemented in a live table game version or electronic version.

30 Claims, 3 Drawing Sheets

METHOD OF PLAYING WAGERING GAMES

CROSS REFERENCE TO RELATED APPLICATIONS

This application claims the benefit of U.S. Provisional Application No. 60/329,610, filed Oct. 15, 2001.

FIELD OF THE INVENTION

The embodiments of the present invention relate to a method of playing wagering games. More specifically, wagering games in which a player attempts to randomly cause a series of ranks to be produced with gaming indicia such that the player's success is determined by the number of consecutive series elements which are produced.

BACKGROUND

Although games involving dice are extremely popular in non-gaming environments, only Craps has been successful in a gaming environment. The game of Craps is offered in nearly all casinos. Craps involves two six-sided dice which are rolled two or more times by a designated player (the "shooter"). The fundamental bet in Craps is known as the "pass" bet. The pass line bet is lost on a first roll ("come-out") of 2, 3, or 12. Each pass bet wagerer is paid even money on a come out roll of 7 or 11. In either case, the pass bet is resolved and a new wager must begin. Should the shooter's come out roll be a 4, 5, 6, 8, 9, or 10, that number is identified as the "point." Thereafter, the shooter continues to roll the dice until the point is repeated or a seven is rolled, whichever occurs first. If the point is repeated ("making the point"), each pass wagerer is paid even money on their pass bets and a new game begins with the same shooter. If a seven is rolled ("seven-out") prior to making the point, each pass bet wagerer loses their pass bet and the shooter must relinquish the dice to another participant. Craps also includes a host of additional wager opportunities related to each roll of the dice. For example, players may wager that any number will be rolled on a subsequent roll, bet that the value of each Several other dice games have been attempted in casinos, but without great, or even moderate, success. One such game is known as "Chuck-a-Luck." Chuck-a-Luck is a game involving a single roll of three six-sided dice having associated payouts related to one, two, or three of the dice faces showing a selected number from one to six. Another dice game is known as "Under and Over 7." Under and Over 7 allows players to wager whether the sum of two dice will be less than, more than or equal to seven.

Scarne on Dice, $8^{th}$ edition and published in 1992, lists many other dice games that are not necessarily played in casinos for wagering purposes, but can be played in a pot-style game where each player contributes an ante and the winners divide the money pot. One such game is known as "Thirty-Six." Thirty-Six is a blackjack-style game played with multiple rolls of one die. Another game is known as "Poker Dice" wherein the object is to roll five dice to form poker-style hands.

A non-dice game that relies on a target score or total, namely twenty-one (21), is the game of Blackjack. Players seek to draw any number of cards in an effort to reach a card total of not greater than twenty-one while also achieving a score in excess of the dealer's card total. Additional wagering games based on scoring exist in the prior art and are played with cards, dice, or other gaming indicia.

While popular, a significant disadvantage of Craps, for both the casino and player, is that the game is, or at least has the perception of being, complicated. Therefore, new players are reluctant to step up to a Craps table and face embarrassment for not knowing the rules or etiquette of the game. In addition, Craps can be played at a slow pace because of the numerous wagers being made before each roll and subsequently paid after each roll. Such delays are not conducive to generating income for the casino which generates income on a per roll basis.

A disadvantage associated with nearly every other dice game is the poor payback percentages. For example, Chuck-a-Luck has a house advantage of nearly eight (8) percent, and Under and Over 7 has a house advantage in excess of sixteen (16) percent. By contrast, the house advantage on the popular pass bet in Craps is only 1.41%.

The embodiments of the present invention overcome the disadvantages associated with previous dice wagering games.

SUMMARY

The embodiments of the present invention provide a wagering game having a relatively short duration, thereby increasing casino profits, provide a game with simple rules which can be easily learned by casino patrons, provide a game with a more reasonable house advantage, thereby increasing the likelihood that casino patrons will play for longer periods of time, provide a game where the objective is to maximize a number of series elements produced and provide a game having enhanced payouts as the number of series elements produced increases.

A first embodiment of the present invention provides a method of playing wagering games using one or more dice. According to a first embodiment of the present invention, a player places a wager and rolls a pair of standard six-sided dice a first time. The player then subsequently rolls the dice repeatedly until either a number rolled is less than or equal to a number previously thrown, or a number of throws qualifies for a maximum payout. Once the player stops rolling the dice, the number of total rolls is compared with a predetermined pay table and the wager is resolved. For example, the following pay table could be used:

| roll count | outcome |
|---|---|
| 6 | 50-1 |
| 5 | 25-1 |
| 4 | 15-1 |
| 3 | 5-1 |
| 2 | 1-1 |
| 1 | 1-1 |
| 0 | Lose |

Various modifications to this basic method are discussed herein.

These and various other features which characterize the invention are pointed out with particularity in the claims annexed hereto and which form a part hereof. However, for a better understanding of the invention, its advantages, and the objects obtained by its use, reference should be made to the drawings which form a further part hereof, and to the accompanying descriptive matter, in which there is illustrated and described preferred embodiments of the invention.

DETAILED DESCRIPTION

Figure 1:
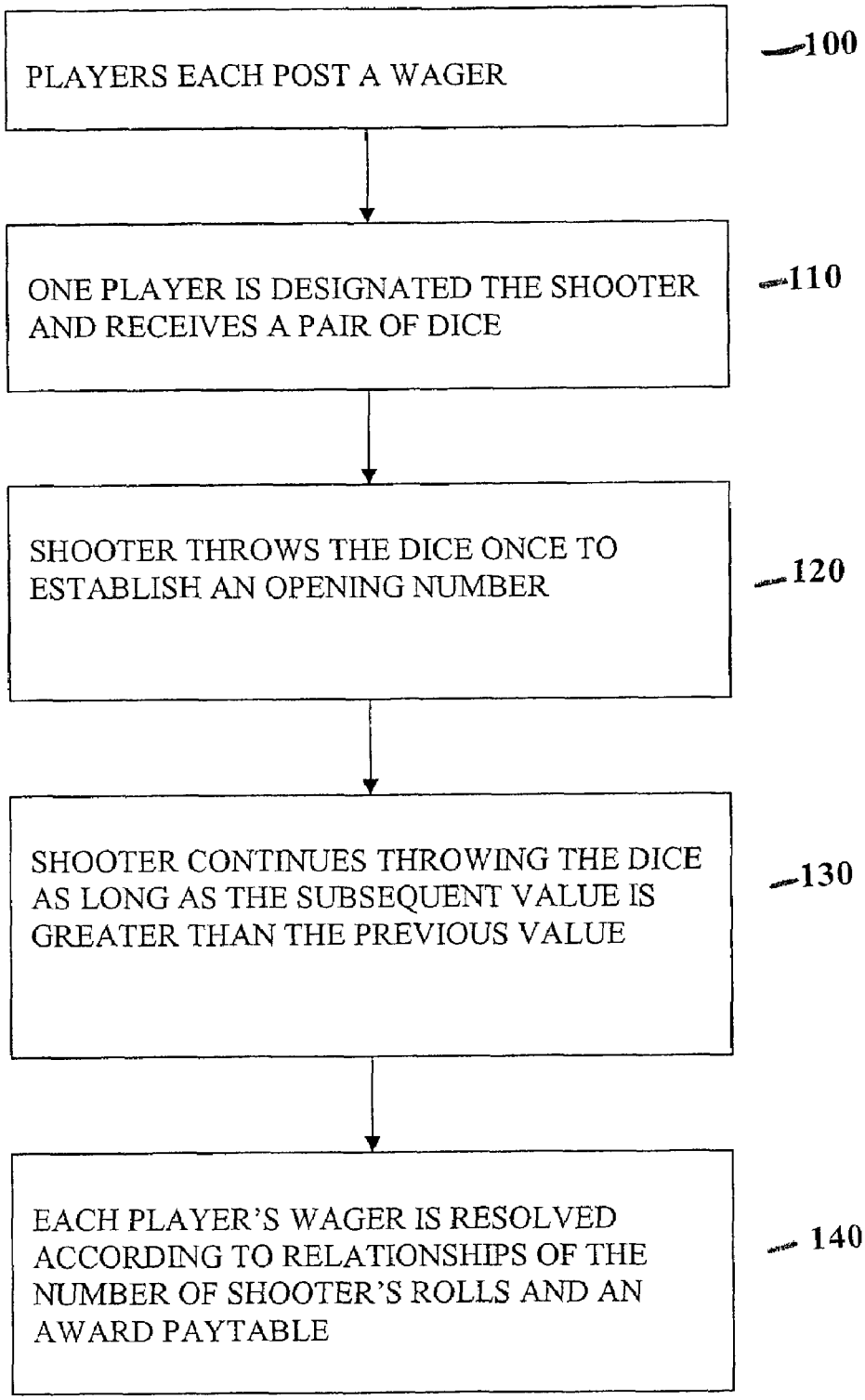
FIG. 1 is a flow chart illustrating steps of playing a wagering game according to the first embodiment of the present invention.

Referring now to FIG. 1, a method of playing a wagering game according to a first embodiment of the present invention is described. The first embodiment of the present invention utilizes two standard six-sided dice. The wagering game may be played by one or more players, in electronic video formats, on personal computers, over a global computer network or in a live casino table game setting. Moreover, besides dice, other gaming indicia having a value including playing cards, dominos, numbered tokens or tiles may be employed. Such valued gaming indicia may comprise tangible physical objects or electronic representations appearing on an electronic video gaming device or computer monitor.

In a live dice game format, each of the one or more players is first afforded an opportunity to place a wager 100 to participate in the wagering game. One wagering player is selected as the shooter 110. It is contemplated that the players and dealer(s) stand about the perimeter of a dice table of the type commonly used in the game of Craps. However, the table layout may be designed to facilitate and enhance the embodiments of the present invention. Once the wagers are placed, the shooter rolls the dice to the far end of the table. The dealer then calculates and records the first sum of the "opening roll" of the dice 120. The dealer then returns the dice to the shooter and indicates that the number of consecutive rolls greater than the previous roll ("roll count") is zero. Thereafter, the shooter again rolls the dice to the far end of the table such that the dealer calculates the second sum thereof and compares the second sum to the first sum previously calculated and recorded. If the second sum is greater than the first sum, the dealer increments the shooter's roll count by one and returns the dice to the shooter for a third roll 130. The shooter continues rolling until the sum of the roll is less than or equal to the sum of the previous roll or the shooter's roll count equals a maximum predetermined roll count, whichever occurs first. Once the shooter's roll is concluded, the shooter's roll count is compared to a pay table and each player's wager is resolved 140. In a live game, the dice move to a subsequent player in the event of a loss and remain with the shooter in the event of a win.

It is understood that any number of pay tables may be created as long as the payouts are attractive to the players and profitable for the house. Therefore, modifications to the number of payouts and the maximum number of rolls needed to achieve a maximum payout are contemplated.

As indicated previously, the table layout may be designed to facilitate and enhance the embodiments of the present invention. For example, the table layout may include a designation for identifying the current roll count, wagering areas for players to place their wagers and a pay table to inform players of the payouts related to different wagers. Said different wagers are disclosed hereinafter.

The first embodiment achieves several features that overcome the disadvantages associated with prior dice games including a possible maximum duration of seven rolls per game, simple rules and an acceptable house advantage of 1.108%. It is noted that although the house advantage is not as significant as that associated with Craps, the house stands to make more revenue based on the faster pace of the embodiments of the present invention.

Several modifications of the first embodiment of the present invention are implemented by the selection of various alternative options, as set forth below. The various alternative options discussed below may be employed alone or in any combination or permutation.

While the first embodiment requires that the sum of each subsequent roll of the dice increase over the previous sum, various alternative criteria may be used to determine a winning series of rolls. For example, a winning series of rolls may be dependent upon each subsequent sum being equal to, or greater than, the previous sum, a winning series may be dependent upon each subsequent sum alternating between odd and even, a winning series may be dependent upon each subsequent sum being less than, or less than or equal to, the previous sum, or a winning series may be dependent upon each subsequent sum alternating between greater than seven and less than seven.

Figure 2:
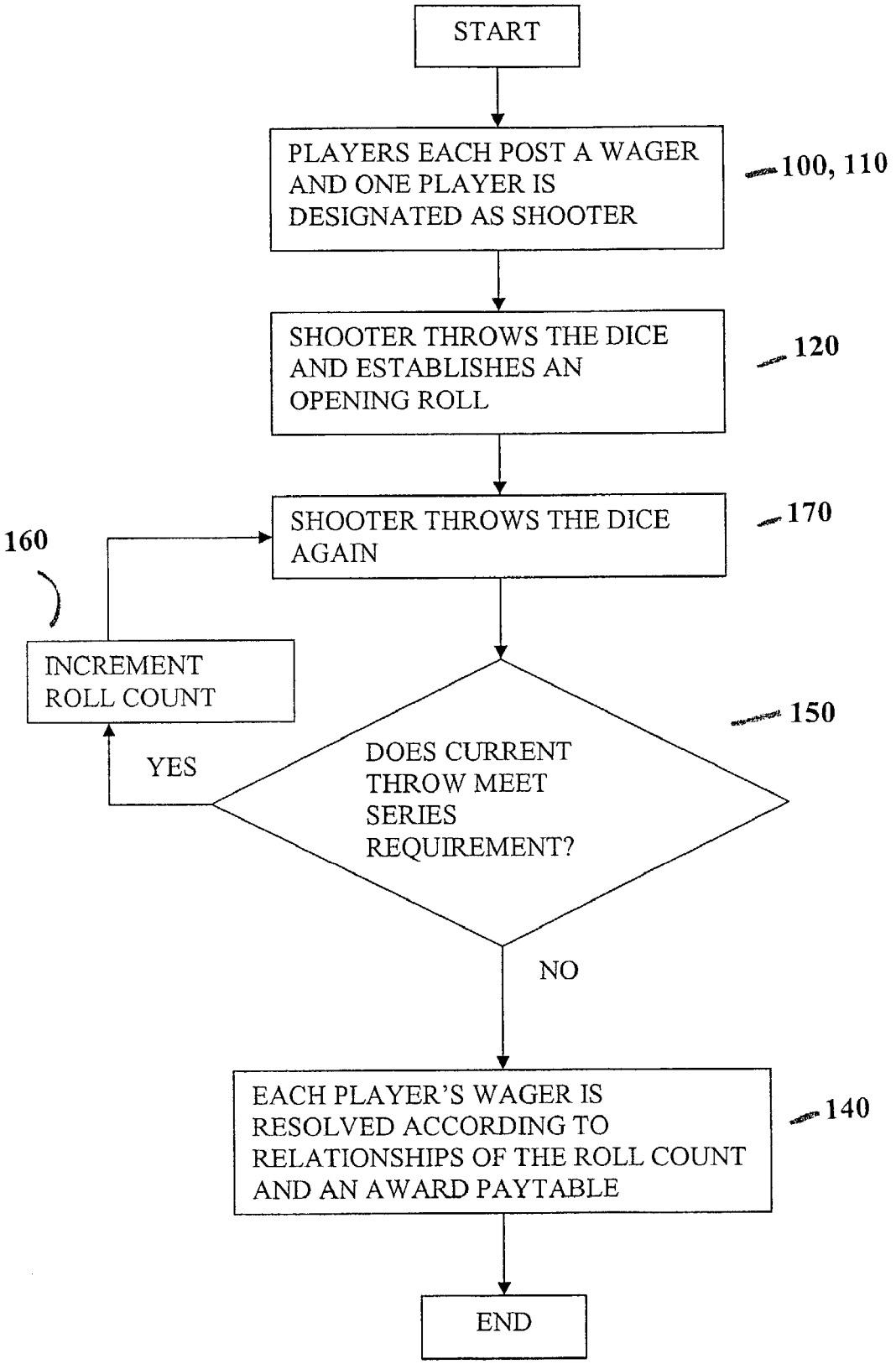
FIG. 2 is a flow chart illustrating steps of playing a wagering game according to a second embodiment of the present invention.

As shown in FIG. 2, any series of values may be instituted. Once the dice are rolled twice, it is determined whether a series has been continued 150. If yes, the roll count is incremented by one 160 and the player is permitted to roll again 170. If no, the shooter's roll count is compared to a pay table and each player's wager is resolved 140.

A second alternative embodiment envisions the use of one die or more than two dice. In a playing card embodiment, cards may be randomly selected individually or in multiple numbers.

In the first embodiment, each sum is treated equally for the purposes of determining whether the roll series continues. Alternatively, certain sums may trigger game variations. For example, a predetermined sum may reset the previous sum to zero. Pursuant to the first embodiment, should the shooter's roll series read 4, 7, 9, and 12 the series must end with a final roll count of three since it is not possible to exceed a sum of 12 with two dice. However, treating the sum of 12 as a reset sum, the same roll series could continue and read 4, 7, 9, 12, 6, 9, 2 such that the final roll count would be five. Alternatively, a predetermined sum may change the requirements of the roll series from "greater than" to "less than." For example, if the sum 12 changed the roll series requirement from "greater than" to "less than", the shooter's roll series could read 4, 7, 9, 12, 10, 5, 3, 7 resulting in a final roll count of six.

In another variation, a predetermined sum increments the roll count but does not end the roll series or modify the previous sum. As an example, if the sum of 2 acted as a "free roll" and did not end the roll series, the shooter's roll series could read 4, 7, 2, 9, 2, 2, 10, 8 resulting in a final roll count of six.

Similar to Craps, a variety of proposition or side bets may be offered in conjunction with the main wager. Such proposition or side wagers include a wager, having a large payout, dependent on the number consecutive winning rolls obtained by a single shooter. For example, five consecutive wins may pay 50-to-1 or six consecutive wins may pay 100-to-1. It is also contemplated that players may wager that a shooter will not achieve certain predetermined roll counts.

A variety of single-roll wagers including, bets on whether a single number will show, bets on whether one of a group of numbers will show and/or bets on the exact throw of the dice. These bets will utilize appropriate payout ratios. Corresponding odds can be set as desired.

It should be understood that the embodiments of the present invention disclosed herein are also ideal for implementation in an electronic gaming machine. It is well known to utilize gaming machines, controlled by processing units, for operating wagering games. The processing unit is typically a computer microprocessor. The first embodiment of the present invention will be used to describe a gaming machine implemented version of the present invention.

Figure 3:
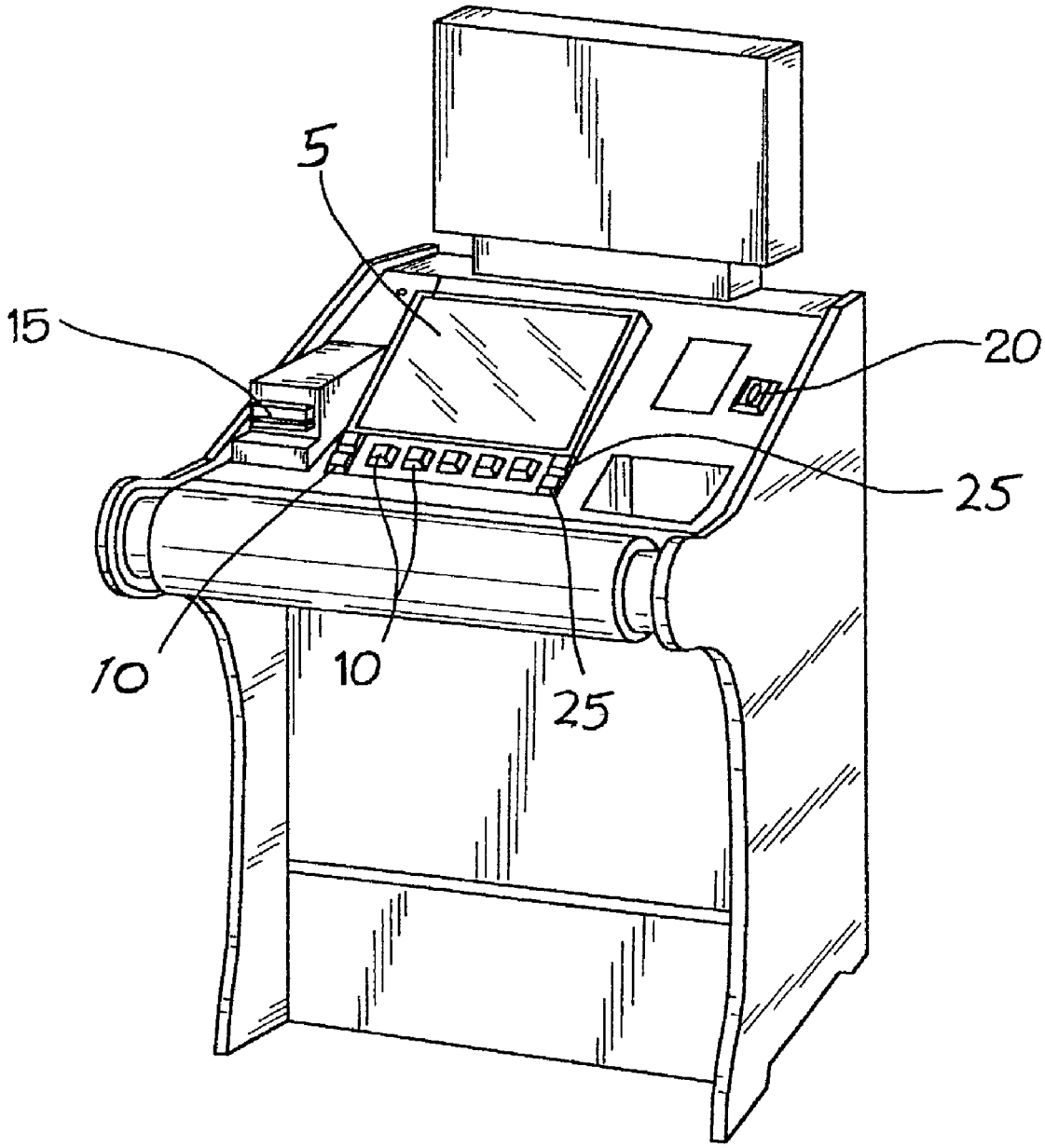
FIG. 3 illustrates a perspective front view of a traditional gaming machine that may be used to implement the embodiments of the present invention.

FIG. 3 illustrates a perspective front view of a traditional gaming machine that may be used to implement the embodiments of the present invention. The gaming machine includes a screen display 5, selection buttons 10, card reader 15, coin slot 20, and wager buttons 25.

The gaming machine may also incorporate a wager accepting means, such as a bill acceptor in addition to the coin slot 20, such that a player may place one or more wagers. Once a wager is accepted, a gaming machine processor generates a roll of two six-sided dice and calculates and displays the sum of each of the two rolls. Should the second sum be greater than the first sum, the machine causes successive rolls until a successive roll sum fails to be greater than a previous roll sum or a maximum number of rolls is achieved. Once the game ends, the machine's processor determines a player award, if any, based on the total number of rolls achieved. Each of the embodiments of the present invention can be practiced by means of an electronic gaming machine or in a live setting at a wagering table.

It is to be understood, however, that even though numerous characteristics of the present invention have been set forth in the foregoing description, together with an explanation of various possible embodiments and modifications thereto, this disclosure is illustrative only and changes may be made within the spirit of the invention to the full extent indicated by the broad general meaning of the terms in which the appended claims are expressed.

I claim:

1. A method of conducting a wagering dice game, comprising:

providing one or more dice;

receiving a player wager;

calculating and recording at least a first sum of a first roll of the one or more dice and a second sum of a second roll of the one or more dice;

comparing the second sum to the first sum and, if applicable, each successive roll sum to an immediate prior roll sum;

if said comparison is of a predetermined nature, incrementing a total roll count by one and re-rolling the one or more dice wherein each re-roll of the one or more dice is compared to the immediate prior roll sum;

if said comparison is not of a predetermined nature or a predetermined maximum total roll count has been reached, ending the game and comparing a final total roll count to a pre-established pay table; and if the comparison of the second sum to the first sum is of a pre-determined nature, paying the player an award based on the player wager using said pay table, wherein the award is related to the final total roll count such that higher final total roll counts correspond to the award being higher.

2. The method of claim 1 wherein said predetermined nature requires the sum of each successive roll of the dice to be greater than the sum of the prior roll.

3. The method of claim 1 wherein said predetermined nature requires the sum of each successive roll of the dice to be greater than, or equal to, the sum of the prior roll.

4. The method of claim 1 wherein said predetermined nature requires the sum of each successive roll of the dice to be less than the sum of the prior roll.

5. The method of claim 1 wherein said predetermined nature requires the sum of each successive roll of the dice to be less than, or equal to, the sum of the prior roll.

6. The method of claim 1 wherein the predetermined nature is ignored should a predetermined neutral sum be rolled.

7. The method of claim 6 wherein the total roll count is incremented by one if the predetermined neutral sum is rolled.

8. The method of claim 1 wherein the predetermined nature requires the sum of each successive roll to alternate between odd and even values.

9. The method of claim 1 wherein the predetermined nature requires the sum of each successive roll to alternate between greater than, and less than, a predetermined number.

10. A method of conducting a wagering dice game, comprising:

providing a die or dice;

receiving a player wager;

calculating and recording a sum of at least a first roll of the die or dice and a separate sum of a second roll of the die or dice;

determining whether the separate sums of the first and second rolls of the die or dice are defined by a predetermined series and, if applicable, each successive roll sum to an immediate prior roll sum;

if said sums of each successive two rolls are defined by the predetermined series, incrementing a total roll count by one and re-rolling the die or dice wherein each re-roll of the die or dice is compared to the immediate prior roll sum;

if said sums of any successive two rolls are not defined by the predetermined series or a predetermined maximum total roll count has been reached, ending the game and comparing a final total roll count to a pre-established pay table; and if the comparison of the sum of the first roll to the sum of the second roll is of a pre-determined nature, paying the player an award based on the player wager using said pay table, wherein the award is related to the final total roll count such that higher final total roll counts corresponds to the award being higher.

11. The method of claim 10 wherein said predetermined series is such that the sum of each successive roll of the dice must be greater than the sum of the prior roll.

12. The method of claim 10 wherein said predetermined series is such that the sum of each successive roll of the dice be greater than, or equal to, the sum of the prior roll.

13. The method of claim 10 wherein said predetermined series is such that the sum of each successive roll of the dice be less than the sum of the prior roll.

14. The method of claim 10 wherein said predetermined series is such that the sum of each successive roll of the dice be less than, or equal to, the sum of the prior roll.

15. The method of claim 10 wherein the predetermined series is ignored should a predetermined neutral sum be rolled.

16. The method of claim 15 wherein the total roll count is incremented by one if the predetermined neutral sum is rolled.

17. The method of claim 10 wherein the predetermined series is such that the sum of each successive roll must alternate between odd and even values.

18. The method of claim 10 wherein the predetermined series is such that the sum of each successive roll must alternate between greater than, and less than, a predetermined number.

19. A method of conducting a wagering game comprising:

providing one or more gaming indicia;

receiving a player wager;

calculating and recording a first sum of a first random prompt of the one or more gaming indicia and a second sum of a second random prompt of the one or more gaming indicia, said gaming indicia having an associated value;

comparing each successive sum of said gaming indicia to an immediate prior sum of the gaming indicia wherein each gaming indicia sum is compared to the immediate prior sum;

if said comparison is of a predetermined nature, incrementing a running total by one and prompting said gaming indicia again;

if said comparison is not of a predetermined nature or a predetermined maximum running total has been reached, ending the game and comparing a final running total to a pre-established pay table; and if the comparison of the second sum to the first sum is of a pre-determined nature, paying the player an award based on the player wager using said pay table, wherein the award is determine based on the final running total.

20. The method of claim 19 wherein said predetermined nature requires the sum of each successive prompting of the gaming indicia to be greater than the sum of the prior prompting of the gaming indicia.

21. The method of claim 19 wherein said predetermined nature requires the sum of each successive prompting of the gaming indicia to be greater than, or equal to, the sum of the prior prompting of the gaming indicia.

22. The method of claim 19 wherein said predetermined nature requires the sum of each successive prompting of the gaming indicia to be less than the sum of the prior prompting of the gaming indicia.

23. The method of claim 19 wherein said predetermined nature requires the sum of each successive prompting of the gaming indicia to be less than, or equal to, the sum of the prior prompting of the gaming indicia.

24. The method of claim 19 wherein the predetermined nature is ignored should a predetermined neutral sum result from the prompting of the gaming indicia.

25. The method of claim 24 wherein the total running count is incremented by one if the predetermined neutral sum results from the prompting of the gaming indicia.

26. The method of claim 19 wherein the predetermined nature requires the sum of each successive prompting of the gaming indicia to alternate between odd and even values.

27. The method of claim 19 wherein the predetermined nature requires the sum of each successive roll to alternate between greater than, and less than, a predetermined number.

28. The method of claim 1 wherein the method is facilitated by an electronic gaming machine.

29. The method of claim 10 wherein the method is facilitated by an electronic gaming machine.

30. The method of claim 19 wherein the method is facilitated by an electronic gaming machine.

* * * * *